United States Patent [19]

Hodgkin

[11] 4,239,479

[45] Dec. 16, 1980

[54] FLUIDIZED BED COMBUSTION

[75] Inventor: Alan F. Hodgkin, Hertfordshire, England

[73] Assignee: Babcock & Wilcox Limited, London, England

[21] Appl. No.: 927,035

[22] Filed: Jul. 24, 1978

[30] Foreign Application Priority Data

Jul. 26, 1977 [GB] United Kingdom ..... 31287/77

[51] Int. Cl.[3] ..... F23D 19/00

[52] U.S. Cl. ..... 431/170; 122/4 D

[58] Field of Search ..... 431/7, 170; 122/4 D; 110/243, 245; 432/14, 15, 58

[56] References Cited

U.S. PATENT DOCUMENTS

| | | | |
|---|---|---|---|
| 3,807,090 | 4/1974 | Moss | 122/4 D |
| 3,814,568 | 6/1974 | Wittman | 431/7 |

*Primary Examiner*—Carroll B. Dority, Jr.
*Assistant Examiner*—Lee E. Barrett
*Attorney, Agent, or Firm*—Kemon & Estabrook

[57] ABSTRACT

The invention relates to fluidized bed combustors that might tilt in use so that the depth of the bed progressively changes across its width. Air is supplied from two or more sources and means are provided to vary the flow from the sources as the bed tilts so that the air supplied to the portion of the bed of increased depth is increased relatively to the air supplied to the portion of the bed of lesser depth.

7 Claims, 6 Drawing Figures

FLUIDIZED BED COMBUSTION

DESCRIPTION

This invention relates to fluidised bed combustors. In fluidised bed combustors, combustible material is burnt in a bed of refractory material that is aerated so that, during combustion, the bed has some of the characteristics of fluid. Much investigation into the use of fluidised beds is being carried out and there may be advantages in their use on board ship. For such purposes, however, account must be taken of the fact that a ship is liable to roll so that the depth of a bed in a combustor that is fixed relative to the ship is likely to vary. The present invention arose from a consideration of the problems that might arise from the effects of the rolling of a ship on the bed of a fluidised combustor mounted on the ship.

According to the present invention, there is provided a fluidised bed combustor having means for the supply of combustion air through the base of the bed, the means including two or more sources of air extending side-by-side and the combustor being such that the bed may tilt during operation about an axis extending longitudinally of the sources so that the depth of the bed above any source varies relatively to the depth of the bed above any other source with the angle of tilt, and means for controlling the supply of air from each source so that throughout a range of tilting, as one source moves downwardly relative to another, the rate at which air is supplied from that source increases automatically relatively to the rate at which air is supplied from the other source.

Figure 1:
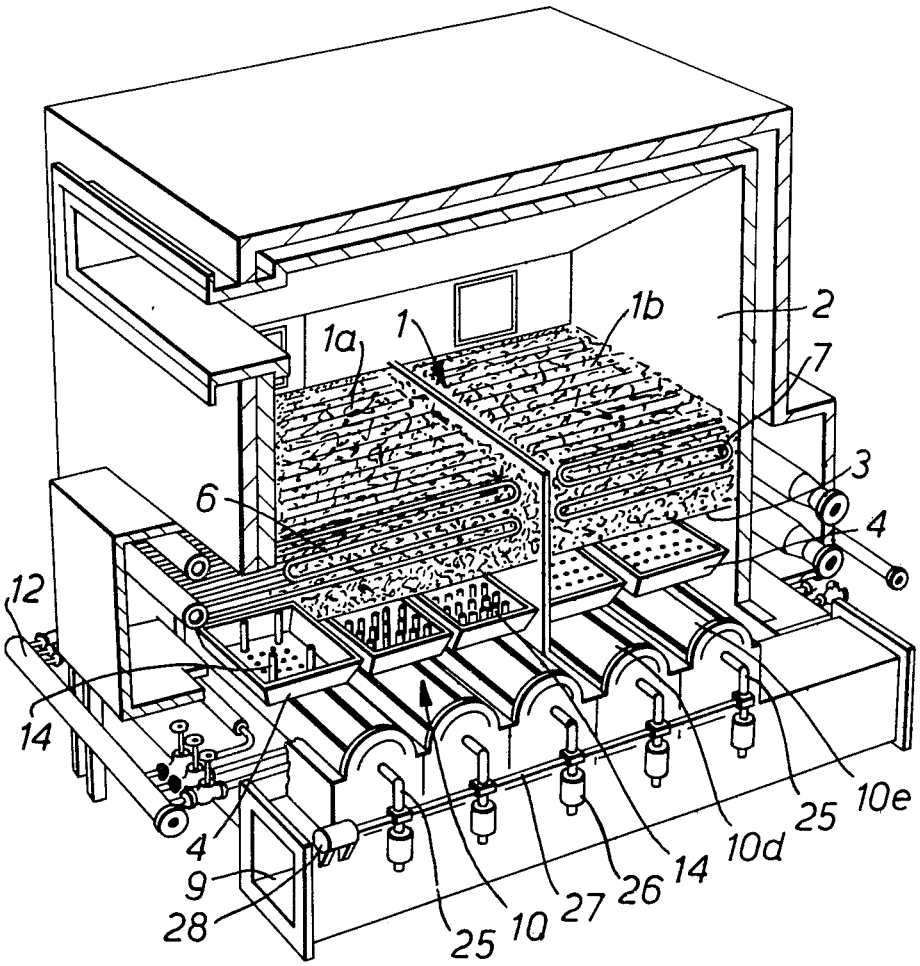
Figure 3:
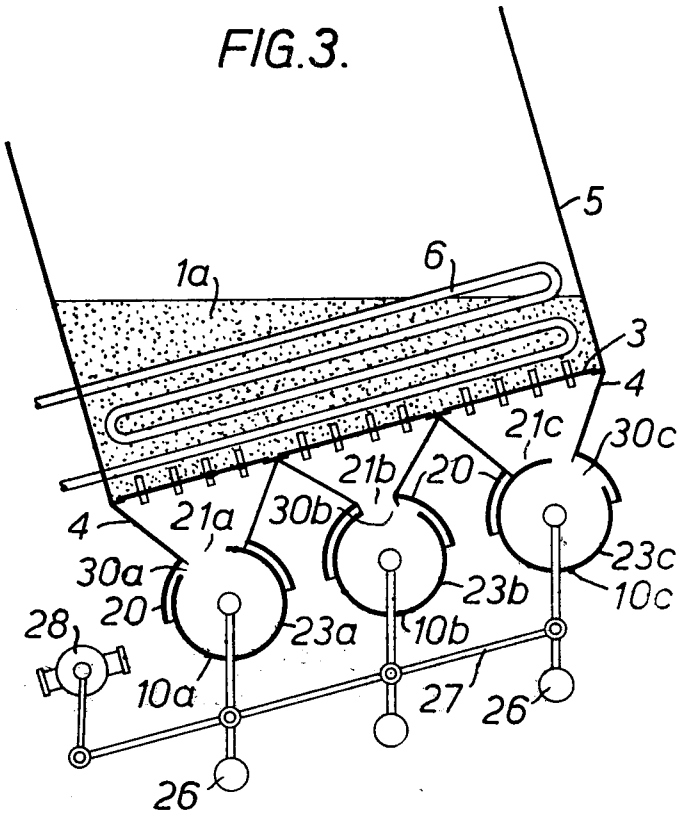
Figure 2:
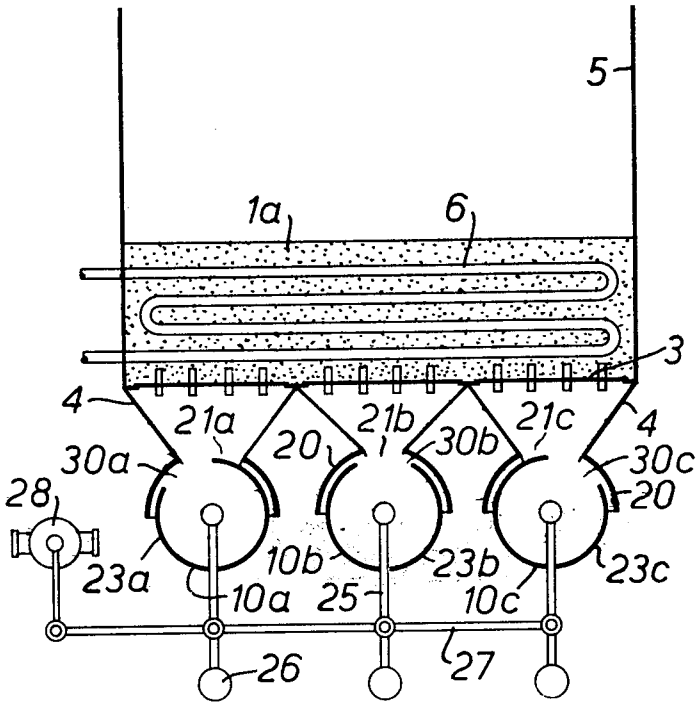
Figure 4:
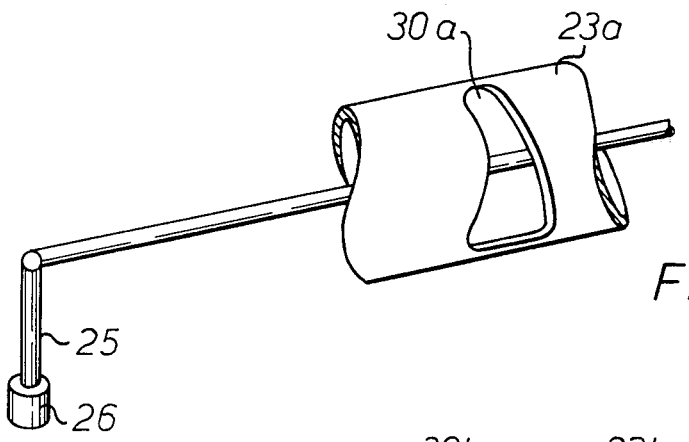
Figure 5:
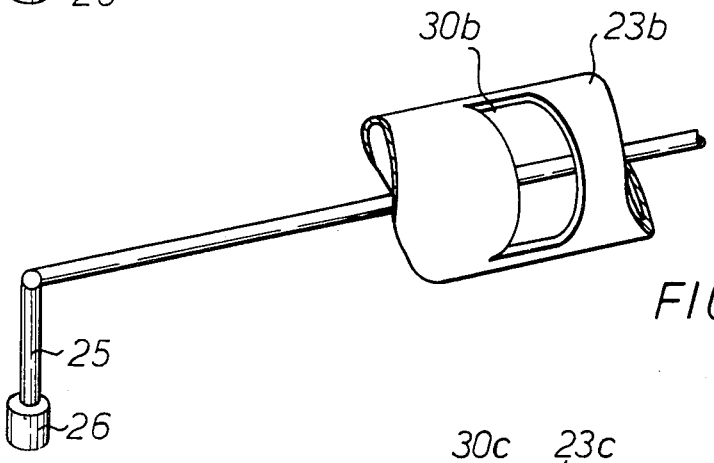
Figure 6:
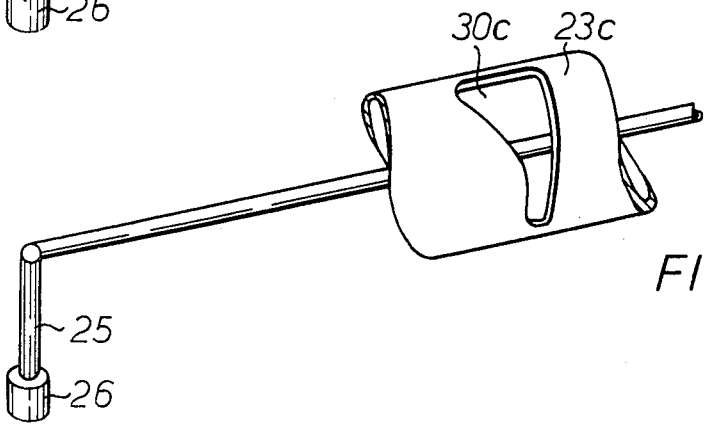

By way of example, an embodiment of the invention will now be described with reference to the accompanying drawings in which FIG. 1 is a perspective view of a fluidised bed combustor, suitable for use in a ship, cut away to various planes to show details more clearly;

FIG. 2 illustrates somewhat schematically an end view of the left hand part of the bed shown in FIG. 1, the combustor being horizontal;

FIG. 3 corresponds to FIG. 2 but with the combustor tilted through 30° about the longitudinal axis of the combustor;

FIGS. 4, 5 and 6 are details illustrating sleeve valves incorporated in the fluidised bed combustor shown in the other Figures.

FIG. 1 illustrates a fluidised bed combustor mounted in a ship and in which a fluidised bed 1 lies at the base of a space 2. The fluidised bed lies on an apertured floor 3 through which air passes upwardly from a row of five plenum air boxes 4.

The fluidised bed 1 is divided into two parts by a vertical baffle 5; the part 1*a*, to the left of the baffle 5, is cooled by tubes 6 through which a fluid is passed whilst the part 1*b*, to the right of the baffle 5, is cooled by fluid-cooled tubes 7.

The side walls of each plenum box 4 converge downwardly to the outlet 21 of a rotary slide valve 10, of which there is one below each of the plenum boxes 4. Air is supplied to each of the boxes 4 through a duct 9, whilst liquid fuel is supplied to fuel nozzles 14, extending upwardly through the boxes 4, by a supply circuit that includes the distributor 12.

Each of the valves 10 includes a fixed part 20 of arcuate cross-section and having a parallel sided opening extending along its length. The opening serves as the outlet 21 from the valve and also as the inlet to the associated plenum box 4. Co-operating with each fixed part 20 is, concentric with it, a drum 23 of which the axis extends in the fore-and-aft direction of the ship. The duct 13 discharges into the rear end of the drum 23. Each drum 23 is provided with a plurality of openings 30, to be referred to in more detail later, and the extent to which the openings 30 are co-incident with the outlet 21 determines the rate at which air flows up into the associated plenum box 4 and so up into the part of the fluidised bed that lies above the plenum box 4.

Each of the drums 23 is rigidly connected to a radially extending member 25 having a weight 26 at its lower end. The members 25 are all parallel to each other and connected to each other by a cross link 27 that is associated with a dashpot 28. The orientation of the drums 23 will be determined by the orientation of the members 25, and the weights 26 will tend to ensure that the members 25 remain vertical despite tilting of the fluidised bed combustor as a result of tilting of the ship in which the combustor is carried. The dashpot 28 will be effective to relate the dynamics of any movement of the members 25 and the drums 23 to the dynamics of the ship and for slow tilting movements of ship, the members 25 will remain essentially vertical so that the openings 30 will also remain constant orientations relatively to the vertical.

If the fluidised bed tilts, however, the fixed parts 20 will move with it. Each will in effect, roll around into associated drum 23, so altering the parts of the openings 30 in the drum 23 that are in register with the opening associated outlet 21.

The central of the three drums shown in FIGS. 2 and 3, 23*b* is provided at intervals spaced along its length with a plurality of openings 30*b* each of constant cross-section and, in arcuate length, greater than the arcuate length of the outlet 21*b* in the associated, fixed part 20*b*. When the bed is level, each opening 30*b* extends to equal extents on each side of the outlet 21*b*. Thus, throughout a pre-determined range of tilt of the ship, equal areas of the outlet 21*b* and the opening 30*b* remain co-incident so that the air flow out of valve 10*b* is independent of the angle of tilt within that range. If the tilt exceeds the limits of that range, then the opening 31*b* becomes partially obstructed.

A similar array of openings 30*a* is provided in the drum 23*a*. One such opening is illustrated in FIG. 4 and is such that its width, in the axial direction increases from one end of the arc to the other, the increase in width increasing with the distance around the arc from the narrower end of the opening 30*a*. When the bed is level, only the narrower end of the opening 30*a* is uncovered by the outlet 21*a* but as the bed tilts in the anticlockwise direction an increasing part, which increases at an increasing degree of tilt, is uncovered by the outlet 21*a*. If the bed tilts in a clockwise direction, then an even smaller part of the opening 30*a* is left uncovered by the outlet 21*a*. When the bed had tilted in the clockwise direction to such an extent that the depth of the bed above the valve 10*a* is below is pre-determined value, the valve 10*a* becomes closed completely so that there is no further flow through it.

The openings 30*c* in the drum 23*c* of valve 10*c* are similar to those in the drum 23*a* but are reversed so that as a smaller part of the openings in one of the drums becomes exposed, a greater part of the openings in the other drum becomes exposed. The width of the outlets 21*a* and 21*c* are greater than that of the outlet 21*b* to better accommodate the changes in flow through the outlets with tilting of the bed.

In the embodiment that has been described, the drum of the valve 10*d* is similar to the drum 23*a* and the drum of the valve 10*e* is similar to the drum 23*c*. In modifications, the openings 30 that are illustrated may be replaced by greater numbers of smaller openings. Where it is desired, as in drums 23*a* and 23*c*, that the rate of flow of air should vary progressively with variations in tilt, this may be achieved by varying the number of openings per unit area of the drum surface. It is also envisaged that instead of controlling the rate at which air can leave the drum, the rate at which air enters the drums should be controlled. Each drum might, for instance, have end walls provided with openings through which air enters the drum and that are uncovered to an extent that depends upon the degree of rotation of the fluidised bed.

In other modifications of what has been described, the link 27 may be omitted, and the valves not connected together. Where a linkage is provided, the dashpot may be omitted.

I claim:

1. A fluidised bed combustor having means for the supply of combustion air through the base of the bed, the means including two or more sources of air extending side-by-side and the combustor being such that the bed may tilt during operation about an axis extending longitudinally of the sources so that the depth of the bed above any source varies relatively to the depth of the bed above any other source with the angle of tilt, and means for controlling the supply of air from each source so that, throughout a range of tilting, as one source moves downwardly relative to another, the rate at which air is supplied from that source increases automatically relatively to the rate at which air is supplied from the other source.

2. A fluidised bed combustor as claimed in claim 1, in which there is an odd number of sources, one extends centrally of the bed, and the rate at which air is supplied from that source remains constant throughout a predetermined degree of tilt from the horizontal.

3. A fluidised bed combustor as claimed in either claims 1 or 2 in which the base of the bed forms the upper boundary of a plenum that is constituted by several sections, each source being one of the sections.

4. A fluidised bed combustor as claimed in claim 1 wherein the means for controlling the supply of air is such that, through part of the range at least, there is an increase with increasing tilt in the rate at which the relative supply of air increases.

5. A fluidised bed combustor as claimed in claim 1 wherein the means for controlling the supply of air from any source includes a member movable with the bed and a member of which the orientation to the vertical is kept constant by a gravitational force.

6. A fluidised bed combustor as claimed in claim 1 wherein the rate at which air is supplied from a source is controlled by a slide valve having a portion fixed relatively to the bed and a portion that is linked with, to move simultaneously with, the corresponding portion of each of the other slide valves.

7. A fluidised bed combustor as claimed in claim 6 in which each slide valve is a rotary valve.

* * * * *